US009224294B1

(12) United States Patent
St. John

(10) Patent No.: US 9,224,294 B1
(45) Date of Patent: Dec. 29, 2015

(54) AUTOMOBILE EMERGENCY VEHICLE WARNING DISPLAY SYSTEM

(71) Applicant: Phyllis St. John, Palmdale, CA (US)

(72) Inventor: Phyllis St. John, Palmdale, CA (US)

( * ) Notice: Subject to any disclaimer, the term of this patent is extended or adjusted under 35 U.S.C. 154(b) by 79 days.

(21) Appl. No.: 14/192,670

(22) Filed: Feb. 27, 2014

Related U.S. Application Data

(60) Provisional application No. 61/810,219, filed on Apr. 9, 2013.

(51) Int. Cl.
*G08G 1/07* (2006.01)
*G08G 1/0965* (2006.01)

(52) U.S. Cl.
CPC ..... *G08G 1/0965* (2013.01)

(58) Field of Classification Search
CPC ..... G08G 1/0965; G08G 1/087; G08G 1/092; G08G 1/094; G08G 1/095; G08G 1/097; G08G 1/161; G08G 1/162; G08G 1/163; G08G 1/205; G08B 1/08; G08B 25/012; G08B 25/016; G08B 27/00; G08B 5/36; B60Q 1/52; B60Q 5/00; B60Q 9/00; B60R 1/12; B60R 2001/1215; B60R 2001/1223; B60R 2001/1276; B61L 29/246; B61L 29/28; G01S 3/14; G01S 3/802; H04B 1/3822; H04H 20/34; H04H 20/36; H04H 20/59; H04H 20/61; H04H 2201/13; H04H 60/13; Y10S 367/909
See application file for complete search history.

(56) References Cited

U.S. PATENT DOCUMENTS

| | | | | | |
|---|---|---|---|---|---|
| 3,568,144 | A * | 3/1971 | Streb | 340/901 |
| 3,626,365 | A * | 12/1971 | Press et al. | 367/129 |
| 3,760,349 | A * | 9/1973 | Keister et al. | 340/902 |
| 3,784,970 | A * | 1/1974 | Simpkin | 340/902 |
| 3,881,169 | A * | 4/1975 | Malach | 340/906 |
| 3,997,868 | A * | 12/1976 | Ribnick et al. | 340/902 |
| 4,017,825 | A * | 4/1977 | Pichey | 340/906 |
| 4,209,769 | A * | 6/1980 | Chronerberry | 340/902 |
| 4,264,979 | A * | 4/1981 | Gutowski | 455/77 |
| 4,403,208 | A * | 9/1983 | Hodgson et al. | 340/902 |
| 4,704,610 | A * | 11/1987 | Smith et al. | 340/906 |
| 4,775,865 | A * | 10/1988 | Smith et al. | 340/906 |
| 5,495,242 | A * | 2/1996 | Kick et al. | 340/902 |
| 5,572,201 | A * | 11/1996 | Graham et al. | 340/902 |
| 5,959,551 | A * | 9/1999 | Cardillo | 340/902 |
| 6,087,961 | A * | 7/2000 | Markow | 340/902 |
| 6,222,461 | B1 * | 4/2001 | Hazen | 340/901 |
| 6,362,749 | B1 * | 3/2002 | Brill | 340/902 |
| 6,404,351 | B1 | 6/2002 | Beinke | |
| 6,630,891 | B1 * | 10/2003 | Dilling | 340/902 |
| 6,812,854 | B1 * | 11/2004 | Edwin et al. | 340/901 |
| 6,917,306 | B2 * | 7/2005 | Lilja | 340/903 |
| 7,061,402 | B1 * | 6/2006 | Lawson | 340/988 |
| 7,551,102 | B1 * | 6/2009 | Carson | 340/902 |
| 8,620,256 | B2 * | 12/2013 | Stahlin et al. | 455/404.1 |
| 2002/0008635 | A1 * | 1/2002 | Ewing et al. | 340/902 |
| 2004/0036627 | A1 * | 2/2004 | Knoski et al. | 340/902 |
| 2004/0155795 | A1 * | 8/2004 | Quintana | 340/902 |

(Continued)

*Primary Examiner* — Fekadeselassie Girma
(74) *Attorney, Agent, or Firm* — RG Patent Consulting, LLC; Rachel Gilboy

(57) ABSTRACT

An factory installed automobile emergency vehicle warning display system to alert a motorist of an approaching emergency vehicle as the emergency vehicle transmits an RF (or other) signal which is received by a sensory-receiver. The sensory-receiver then communicates to a visual-alarm to display a message and to an audible-alarm to transmit a corresponding audible message through a speaker.

7 Claims, 5 Drawing Sheets

(56) References Cited

U.S. PATENT DOCUMENTS

2007/0001872 A1* 1/2007 Ellison ..... 340/907
2009/0320585 A1* 12/2009 Cohen ..... 73/167
2011/0181408 A1* 7/2011 Greenis et al. ..... 340/539.1
2014/0070962 A1* 3/2014 Holland ..... 340/902
2014/0118553 A1* 5/2014 Diba ..... 348/149
2015/0116133 A1* 4/2015 Mawbey et al. ..... 340/902

* cited by examiner

AUTOMOBILE EMERGENCY VEHICLE WARNING DISPLAY SYSTEM

CROSS-REFERENCE TO RELATED APPLICATION

The present application is related to and claims priority from prior provisional application Ser. No. 61/810,219, filed Apr. 9, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of warning systems and more specifically relates to an automobile emergency vehicle warning display system for passenger vehicles.

2. Description of the Related Art

Emergency vehicles such as fire trucks, ambulances, and police cars frequently must reach an emergency situation as quickly as possible. To facilitate their travel from one point to another location they use warnings systems such as flashing lights and sirens. Even with these warnings systems many motorists are still surprised to see one of these emergency vehicles approaching them from behind, from either the left or the right, or from in front of them. The surprise may be caused because they couldn't hear the sirens due to listening to audio devices while driving. They may also have obstacles to their line of sight so that they cannot see the flashing lights of the approaching emergency vehicle.

Emergency vehicles, such as police cars, ambulances and fire engines, when in an emergency state, travel at a high rate of speed and, usually, do so through crowded streets and roadways. Laws require that other motor vehicles immediately give the right-of-way to the emergency vehicle. The driver of the motor vehicle then must be aware of the approach of the emergency vehicle within a suitable time to safely allow this right-of-way. Motorists become aware of an approaching emergency vehicle in an emergency status via flashing lights, sirens, and horns.

A substantial number of motorists are involved in accidents each year because they were not aware of an approaching emergency vehicle which has the right-of-way in all situations. In 1998, according the National Safety Council, there were over 32,000 accidents involving ambulances, fire trucks, police cars, and other emergency vehicles. It's a big problem with modern cars, vans, SUV's, and trucks featuring soundproofing, 8-speaker 100-watt factory installed stereo sound systems, high volume air conditioning fans, cell phones, and the like. It is desirable that public safety be enhanced, yet not intruding on our comfort level that we have come to expect with modern vehicles.

Thus, there is a need for a warning system in motor vehicles to alert drivers of approaching emergency vehicles. Many motorists simply do not hear sirens as soon as they should which poses danger not only to themselves and passengers, but also to the emergency vehicles and their passengers rushing to arrive at an emergency location.

Various attempts have been made to solve the above-mentioned problems such as those found in U.S. Pat. No. 7,061,402 to Robert Lawson, U.S. Pat. No. 6,404,351 to Dennis Beinke, and U.S. Pub. No. 2002/0008635 to Jimmie L. Ewing, et al. This art is representative of warning systems. None of the above inventions and patents, taken either singly or in combination, is seen to describe the invention as claimed.

Ideally, an automobile emergency vehicle warning display system should provide a motorist with visual and auditory warnings that an emergency vehicle is approaching and, yet would operate reliably and be manufactured at a modest expense. Thus, a need exists for a reliable automobile emergency vehicle warning display system to avoid the above-mentioned problems.

BRIEF SUMMARY OF THE INVENTION

In view of the foregoing disadvantages inherent in the known warning systems art, the present invention provides a novel automobile emergency vehicle warning display system. The general purpose of the present invention, which will be described subsequently in greater detail is to provide a warning system for motorists of an approaching emergency vehicle that extends beyond the flashing lights, sirens, and horns of the emergency vehicle.

An automobile emergency vehicle warning display system is disclosed in a preferred embodiment comprising: an automobile-emergency-vehicle-warning-display-assembly comprising in combination a sensory-receiver, a visual-alarm having a message-display-area, and an audible-alarm having a speaker.

The automobile-emergency-vehicle-warning-display-assembly may be factory installed into a personal-vehicle (in certain preferred embodiments) and is always in a normally-on condition allowing a user to be aware of an approaching emergency-vehicle at all times without having to turn on the automobile-emergency-vehicle-warning-display-assembly.

The sensory-receiver is a factory-installed (OEM) component of a wiring-harness of the personal-vehicle able to receive an approach-signal via a receiver located within the sensory-receiver. The approach-signal comprises a radio-frequency (RF) signal transmitted via a transmitter from the emergency vehicle or may use different communication means suitable and readily available.

The visual-alarm in this embodiment is factory installed in a dashboard of the personal-vehicle and receives an alarm-signal from the sensory-receiver via a communication connector comprising an electric-cable. The visual-alarm, when activated, displays a corresponding message comprising "EMERGENCY VEHICLE APPROACHING" in the message-display-area. Alternate embodiments may use wireless technology.

The sensory-receiver is able to activate the audible-alarm via transmitting an alarm-signal to the audible-alarm via a communication connection means comprising an electric-cable when an emergency vehicle approaches the personal-vehicle within a pre-determined distance as determined by GPS (Global Positioning System or other suitable tracking means). When activated, the audible-alarm communicates an audible message comprising "WARNING EMERGENCY VEHICLE APPROACHING" via the speaker of the audible-alarm.

When in use, a user is able to see the visual-display-message on the visual-alarm activated by the sensory-receiver when the sensory-receiver receives an approach-signal from an emergency vehicle and to simultaneously hear an audible-message via the speaker of the audible-alarm when the audible-alarm is activated by the sensory-receiver. With the warning provided by the automobile emergency vehicle warning display system, the user is able to position a personal-vehicle safely to allow passage of the emergency vehicle thereby increasing public road safety.

The present invention holds significant improvements and serves as an automobile emergency vehicle warning display system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, automobile emergency vehicle warning display system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a warning system and more particularly to an automobile emergency vehicle warning display system as used to improve the awareness of a motorists that an emergency vehicle is approaching so they may take appropriate evasive action safely.

Generally speaking, the automobile emergency vehicle warning display system is a warning system used in motor vehicles to alert motorists of approaching emergency vehicles which send out radio frequency waves to a warning system located within the motor vehicle. Use of the automobile emergency vehicle warning display system allows the motorist to position their vehicle to permit safe passage of the emergency vehicle, thus, improving road safety.

Figure 1:
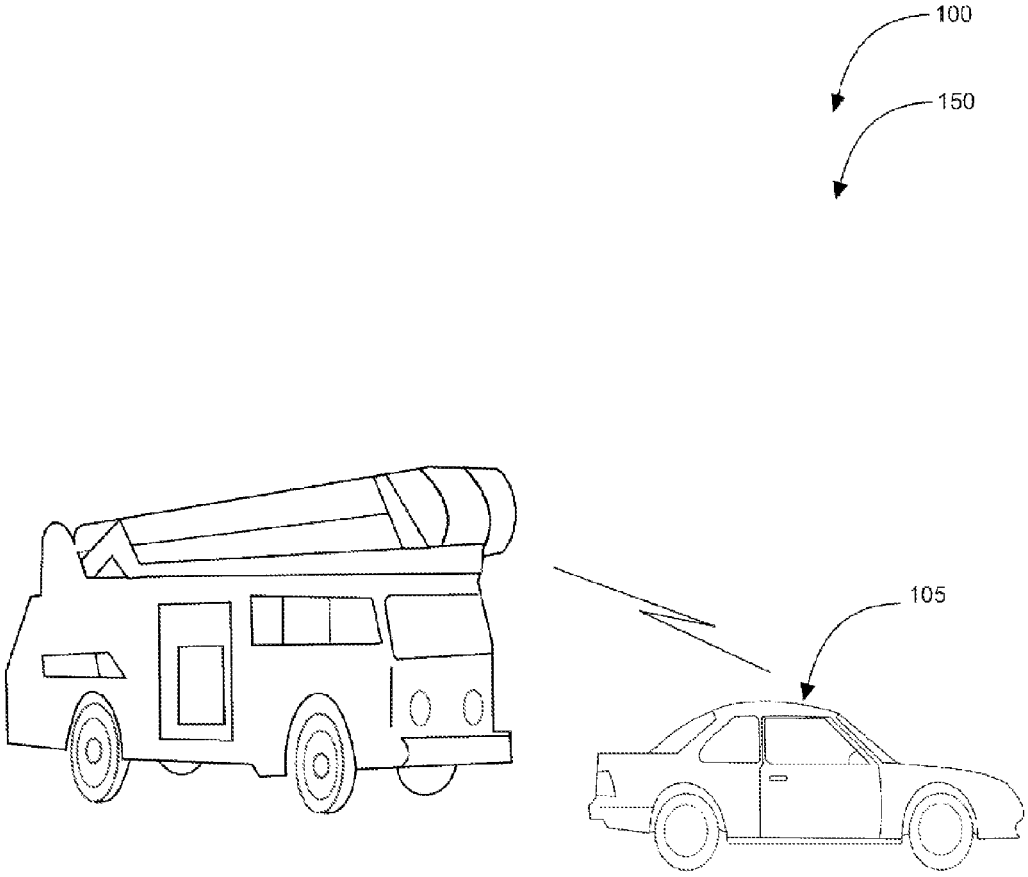
FIG. 1 shows a perspective view illustrating an automobile emergency vehicle warning display system in an in-use condition according to an embodiment of the present invention.

Referring now to the drawings by numerals of reference there is shown in FIG. 1, automobile emergency vehicle warning display system 100 in an in-use condition 150 according to an embodiment of the present invention.

Automobile emergency vehicle warning display system 100 in a preferred embodiment comprises: automobile-emergency-vehicle-warning-display-assembly 110 comprising in functional combination: sensory-receiver 120, visual-alarm 130 (having message-display-area 135), and audible-alarm 140 having speaker 142. When in use, a user is able to see visual-display-message 137 on visual-alarm 130 activated by sensory-receiver 120 when sensory-receiver 120 receives an approach-signal from an emergency vehicle and to simultaneously hear an audible-message via speaker 142 of audible-alarm 140 when audible-alarm 140 is activated by sensory-receiver 120. With the warning provided by automobile emergency vehicle warning display system 100 the user is able to position personal-vehicle 105 safely to allow passage of the emergency vehicle thereby increasing public road safety.

Figure 2:
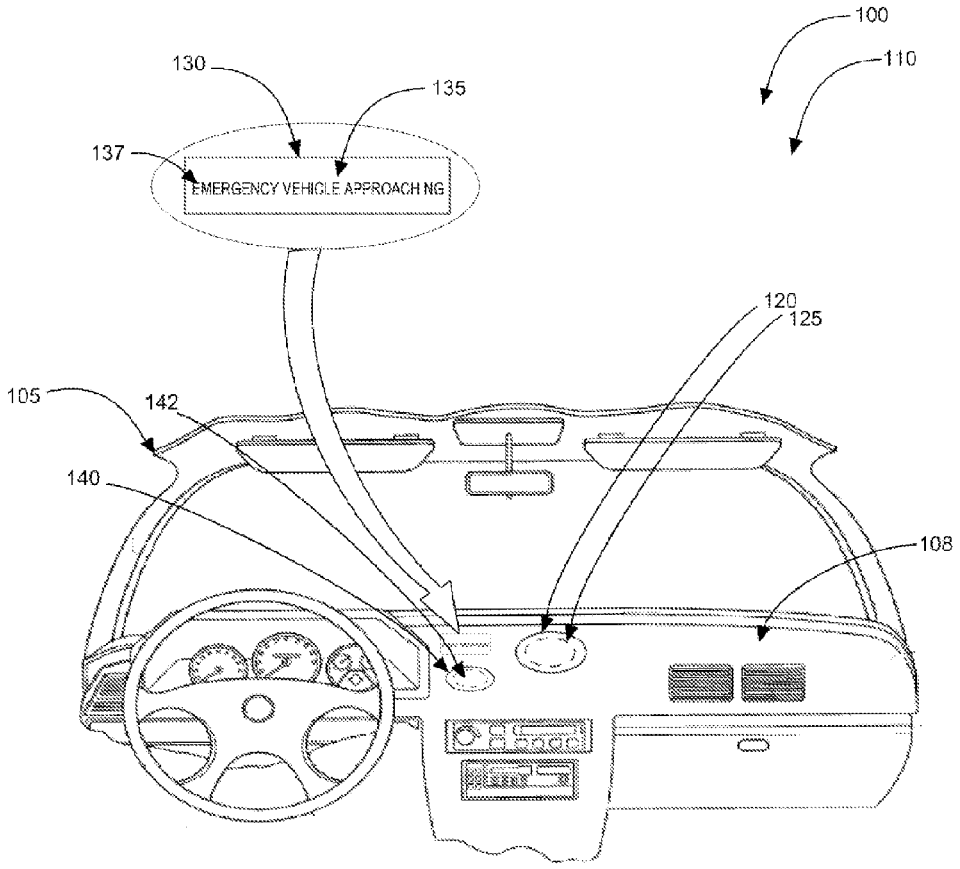
FIG. 2 is a perspective view illustrating an automobile-emergency-vehicle-warning-display-assembly installed into a personal vehicle according to an embodiment of the present invention of FIG. 1.

Referring now to FIG. 2, a perspective view illustrating automobile-emergency-vehicle-warning-display-assembly 110 as installed into personal vehicle 105 according to an embodiment of the present invention of FIG. 1.

Automobile-emergency-vehicle-warning-display-assembly 110 is factory installed into personal-vehicle 105 (OEM) in these particular embodiments and is always in a normally-on condition allowing a user to be aware of an approaching emergency-vehicle at all times without having to turn on automobile-emergency-vehicle-warning-display-assembly 110. Alternate embodiments may comprise on/off activation means.

Sensory-receiver 120 is a factory-installed OEM component of a wiring-harness of personal-vehicle 105 mounted on dashboard 108 of personal-vehicle 105 able to receive an approach-signal via receiver 125 located within sensory-receiver 120. The approach-signal comprises a radio-frequency (RF) signal transmitted via a transmitter from the emergency vehicle. Sensory-receiver 120 is tuned to a specific RF signal used by emergency vehicles. In an alternate embodiment, the approach-signal comprises sound in wavelengths produced by the sirens of an emergency vehicle. In another alternate embodiment the approach-signal comprises strobe lighting used by an emergency vehicle to control traffic lights. Various related means to receive signals may be used.

Visual-alarm 130 is factory installed in dashboard 108 of personal-vehicle 105 and receives an alarm-signal from sensory-receiver 120 via communication connector means 124 comprising an electric-cable (or other suitable cable or non-cable means) located out of sight under dashboard 108. Visual-alarm 130, when activated, displays a corresponding visual-display message 137 comprising "EMERGENCY VEHICLE APPROACHING" in message-display-area 135. In an alternate embodiment communication connector means 124 comprises wireless technology.

Sensory-receiver 120 activates audible-alarm 140 via transmitting an alarm-signal to audible-alarm 140 via communication connection means 124 comprising an electric-cable, located out of sight under dashboard 108, when an emergency vehicle approaches personal-vehicle 105 within a pre-determined distance as determined by GPS. When activated, audible-alarm 140 communicates an audible message comprising "WARNING EMERGENCY VEHICLE APPROACHING" via speaker 142 of audible-alarm 140 mounted in dashboard 108 of personal vehicle 105. In an alternate embodiment communication connector means 124 comprises wireless technology.

Figure 3:
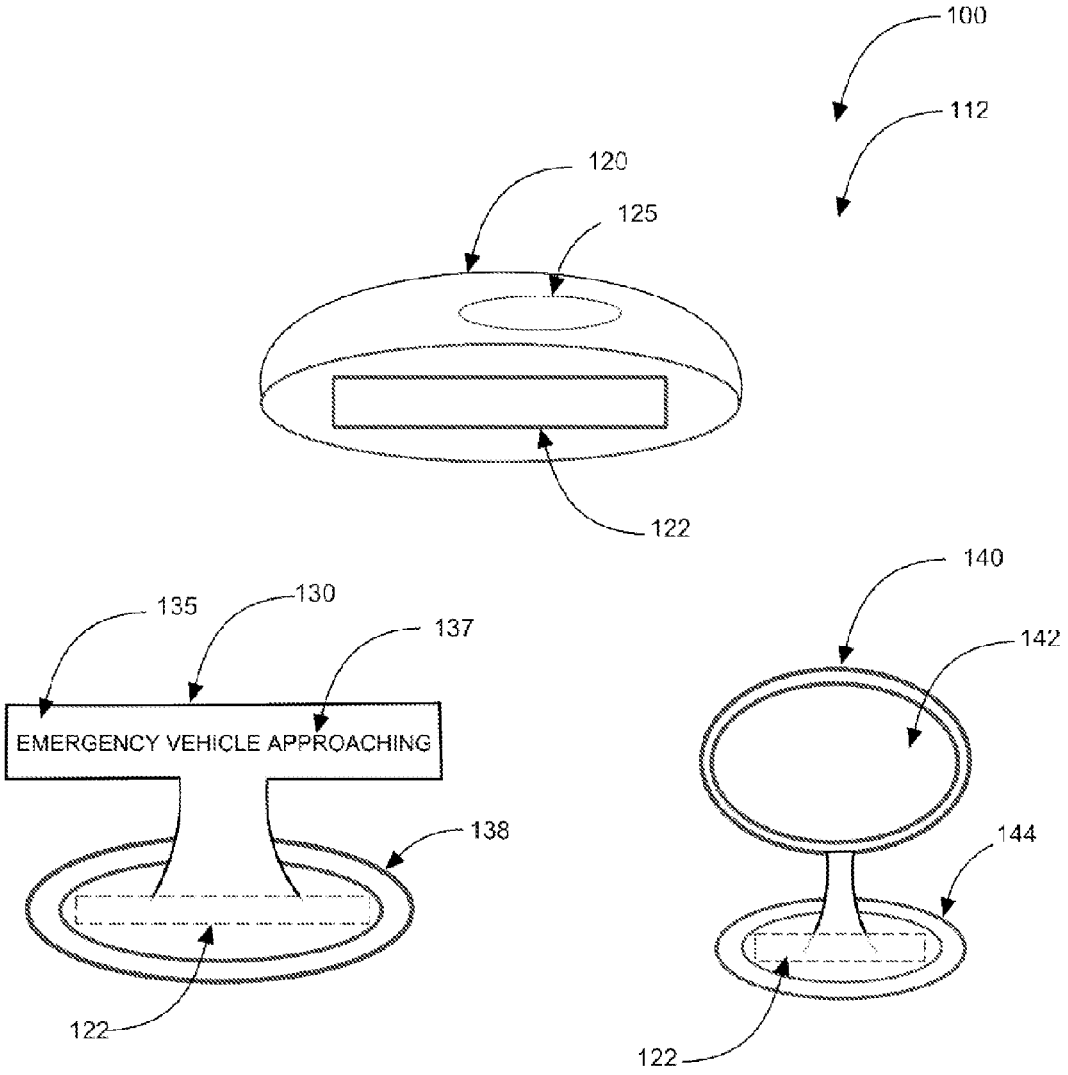
FIG. 3 is a perspective view illustrating components of an aftermarket warning display assembly according to an embodiment of the present invention of FIG. 1.

Referring now to FIG. 3, a perspective view illustrating components of aftermarket warning display assembly 112 according to an embodiment of the present invention.

In an alternate embodiment automobile emergency vehicle warning display system 110 comprises aftermarket warning display assembly 112 comprising in combination sensory-receiver 120, visual-alarm 130 having message-display-area 135 and visual-alarm-stand 138, and audible-alarm 140 having speaker 142 and audible-alarm-stand 144. Aftermarket warning display assembly 112 is portable and able to be transferred between a plurality of personal-vehicles 105. This particular embodiment may be retrofit to existing vehicles after initial manufacture and is portable inbetween such that its use is virtually universal.

Figure 4:
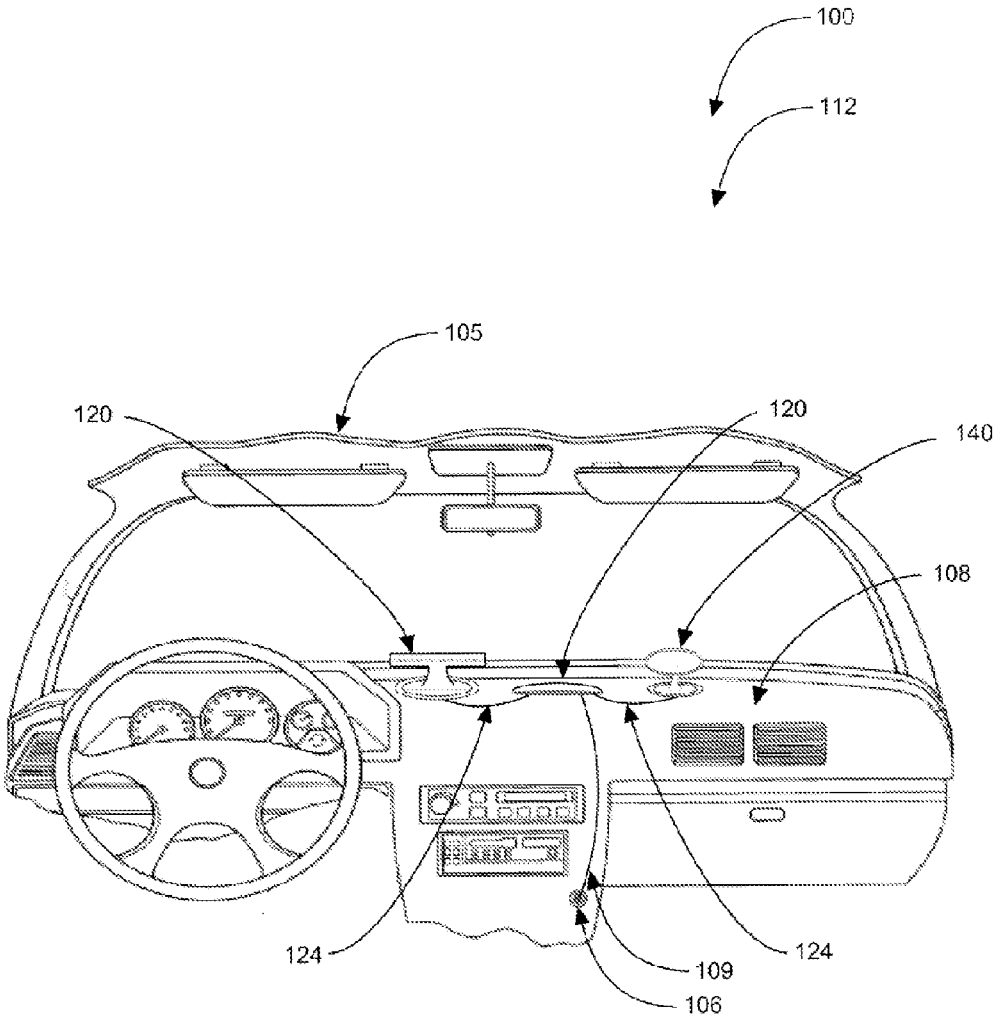
FIG. 4 is a perspective view illustrating an aftermarket warning display assembly removably attached to a personal vehicle dashboard according to an embodiment of the present invention of FIG. 1.

Referring now to FIG. 4, a perspective view illustrating components of aftermarket warning display assembly 112 removably attached to personal-vehicle 105 dashboard 108 according to an embodiment of the present invention of FIG. 1.

A user is able to see visual-display-message 137 in message-display-area 135 when visual-alarm 130 is activated by sensory-receiver 120 after sensory-receiver 120 receives an approach-signal from an emergency vehicle and hear an audible-message from audible-alarm 140 having speaker 142 when audible-alarm 140 is activated by sensory-receiver 120. The user is able to position personal-vehicle 105 safely to allow passage of the emergency vehicle.

Aftermarket warning display assembly 112 receives power from a vehicle-power-source 106 comprising cigarette lighter (or other readily available power providing means) being connected to sensory-receiver 120 via a corded 12 volt lighter plug 109. In an alternate embodiment the power source comprises batteries inside sensory-receiver 120.

Sensory-receiver 120 is detachably-mounted on vehicle-dashboard 108 via attachment-means 122 comprising peel-and-stick adhesive backing. Visual-alarm 130 is removably-mounted on vehicle-dashboard 108 via visual-alarm-stand 138 having attachment-means 122 comprising peel-and-stick adhesive backing. It receives an alarm-signal from sensory-receiver 120 via communication connection means 124 comprising an electric-cable and displays a visual-display-message 137 comprising "EMERGENCY VEHICLE APPROACHING" in message-display-area 135. Audible-alarm 140 is also detachably-mounted on vehicle-dashboard 108 via audible-alarm-stand 144 having attachment-means 122 comprising peel-and-stick adhesive backing and receives an alarm-signal from sensory-receiver 120 via communication connection means 124 comprising an electric-cable and broadcasts a message via speaker 142 comprising "WARNING EMERGENCY VEHICLE APPROACHING".

In an alternate embodiment communication connector means 124 between sensory-receiver 120 and visual-alarm 130 and between sensory-receiver 120 and audible-alarm 140 comprises wireless technology. In an alternate embodiment attachment means comprises hook-and-loop.

Sensory-receiver 120 receives an approach-signal comprising a radio-frequency (RF) signal from an emergency vehicle. In an alternate embodiment, the approach-signal comprises sound in wavelengths produced by the sirens of an emergency vehicle. In another alternate embodiment the approach-signal comprises strobe lighting used by an emergency vehicle to control traffic lights. Sensory-receiver 120 activates visual-alarm 130 via communication connection means 124 between sensory-receiver 120 and visual-alarm 130. Audible-alarm 140 is activated by sensory-receiver 120 via communication connection means 124 between sensory-receiver 120 and audible-alarm 140.

Aftermarket warning display assembly 112 may be sold as kit 440 comprising the following parts: at least one sensory-receiver 120 at least one visual-alarm 130 having message-display-area 135 and visual-alarm-stand 138; at least one audible-alarm 140 having speaker 142 and audible-alarm-stand 144; at least one 12 volt lighter plug 109 for use with a cigarette lighter; at least two connections means 124 comprising electric-cables; at least three attachment means 122 comprising peel-and-stick adhesive backing, and at least one set of user instructions. The kit has instructions such that functional relationships are detailed in relation to the structure of the invention (such that the invention can be used, maintained, or the like in a preferred manner). Automobile emergency vehicle warning display assembly 110 and aftermarket warning display assembly 112 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different signal reception means, parts may be sold separately, etc., may be sufficient.

Figure 5:
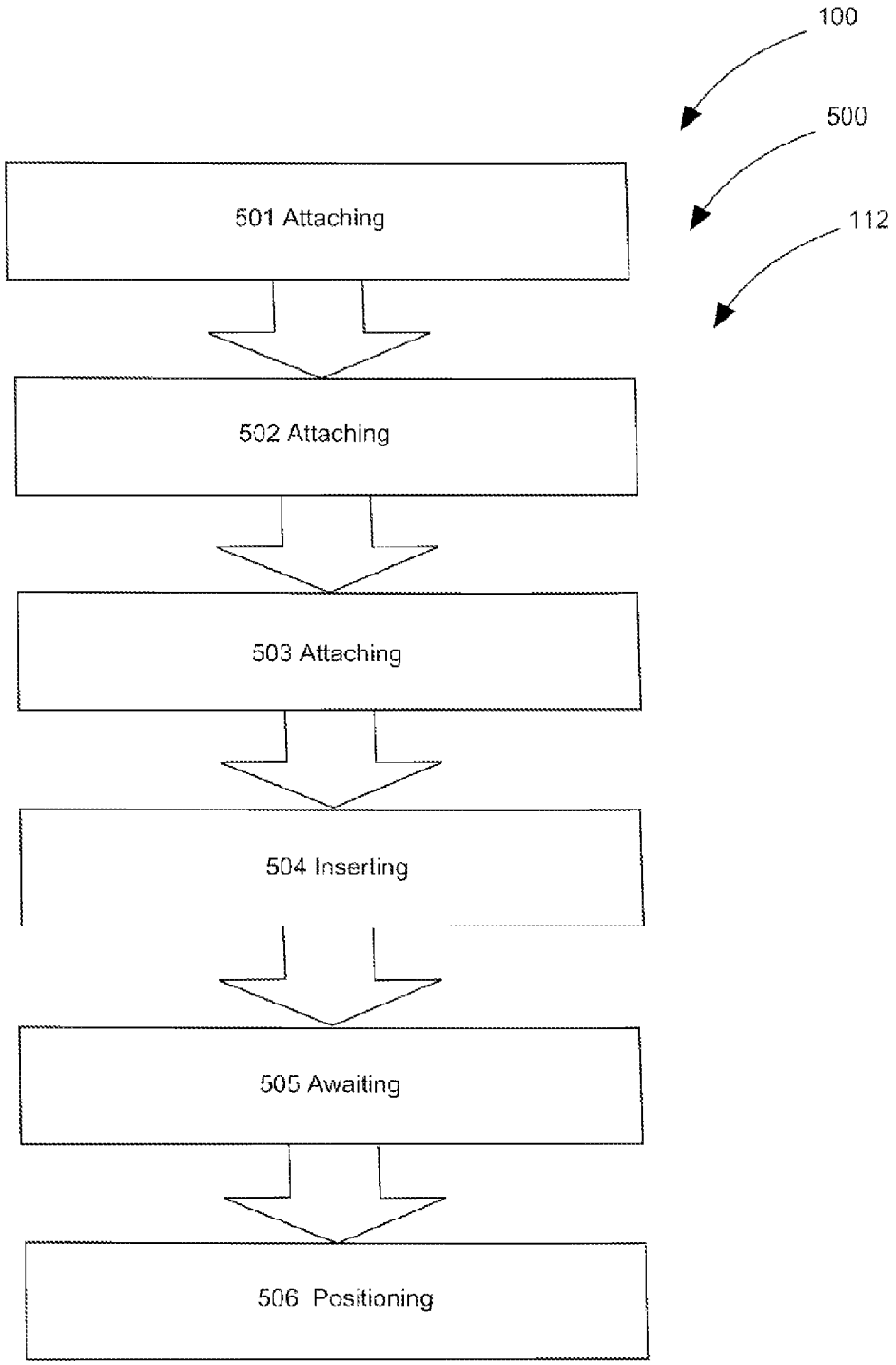
FIG. 5 is a flowchart illustrating a method of use for an aftermarket warning display assembly according to an embodiment of the present invention of FIGS. 3-4.

Referring now to FIG. 5, a flowchart illustrating a method of use for aftermarket warning display assembly 112 according to an embodiment of the present invention of FIGS. 3-4.

A method of use 500 for aftermarket warning display assembly 112 may comprise the steps of: step one 501 attaching sensory-receiver 120 on personal vehicle dashboard 108; step two 502 attaching visual-alarm 130 on personal vehicle dashboard 108; step three 503 attaching audible-alarm 140 on personal vehicle dashboard 108; step four 504 inserting 12 volt lighter plug 109 into vehicle-power-source comprising a cigarette lighter; and step five 505 awaiting the approach of an emergency vehicle to activate sensory-receiver 120, and step six 506 positioning personal-vehicle 105 safely to permit passage of the emergency vehicle when an emergency vehicle is close enough for its approach-signal to activate sensory-receiver 120.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An automobile emergency vehicle warning display system comprising:

an automobile-emergency-vehicle-warning-display-assembly comprising;

a sensory-receiver;

a visual-alarm having a message-display-area; and an audible-alarm having a speaker;

wherein said automobile emergency vehicle warning display system comprises said automobile-emergency-vehicle-warning-display-assembly;

wherein said automobile-emergency-vehicle-warning-display-assembly comprises in combination said sensory-receiver, said visual-alarm having said message-display-area, and said audible-alarm having said speaker;

wherein said sensory-receiver receives an approach-signal via a receiver, said approach-signal transmitted via a transmitter from an emergency vehicle;

wherein said approach-signal comprises strobe lighting used by an emergency vehicle to control traffic lights;

wherein said visual-alarm is activated by said sensory-receiver via a communication connection means between said sensory-receiver and said visual-alarm and displays a corresponding message in said message-display-area;

wherein said audible-alarm is activated by said sensory-receiver via said communication connection means between said sensory-receiver and said audible-alarm having said speaker;

wherein a user is able to see said visual-display-message on said visual-alarm activated by said sensory-receiver when said sensory-receiver receives said approach-signal from said emergency vehicle and to simultaneously hear an audible-message via said speaker of said audible-alarm when said audible-alarm is activated by said sensory-receive; and wherein said user is able to position a personal-vehicle safely to allow passage of said emergency vehicle thereby increasing public road safety;

wherein said visual-alarm is installed in a dashboard of said personal-vehicle and receives an alarm-signal from said sensory-receiver via said communication connector comprising an electric-cable;

wherein said visual-alarm displays said visual-display-message comprising emergency vehicle approaching when said visual-alarm is activated by said sensory-receiver;

wherein said audible-alarm receives said alarm-signal from said sensory-receiver via said connector comprising said electric-cable;

wherein said sensory-receiver transmits said alarm-signal to said audible-alarm when said emergency vehicle approaches said personal-vehicle within a pre-determined distance as determined by GPS;

wherein said audible-alarm-message comprises an audible-message comprising warning emergency vehicle approaching when said audible-alarm receives said alarm-signal from said sensory-receiver;

wherein said audible-alarm-message is communicated to said user via said speaker.

2. The automobile emergency vehicle warning display system of claim 1 wherein said automobile-emergency-vehicle-warning-display-assembly is factory installed into said personal-vehicle.

3. The automobile emergency vehicle warning display system of claim 2 wherein said sensory-receiver is a factory-installed original equipment manufacturer component of a wiring-harness of said personal-vehicle.

4. The automobile emergency vehicle warning display system of claim 1 wherein said factory-installed warning-display-assembly is always in a normally-on condition allowing said user to be aware of an approaching said emergency-vehicle at all times without having to turn on said factory-installed warning-display-assembly.

5. The automobile emergency vehicle warning display system of claim 1 wherein said warning display assembly receives power from a vehicle-power-source comprising a cigarette lighter.

6. The automobile emergency vehicle warning display system of claim 1 wherein said sensory-receiver is detachably-mounted on a vehicle-dashboard via an attachment means comprising peel-and-stick adhesive backing.

7. The automobile emergency vehicle warning display system of claim 5 wherein said power comprises batteries giving said power to said sensory-receiver, said visual-alarm having a message-display and said visual-alarm-stand, and said audible-alarm having said speaker and said audible-alarm-stand.

* * * * *